US005727312A

United States Patent [19]

Maejima et al.

[11] Patent Number: 5,727,312

[45] Date of Patent: Mar. 17, 1998

[54] TERMINAL INSERTING METHOD

[75] Inventors: Takamichi Maejima; Yutaka Miyamoto, both of Haibara-gun, Japan

[73] Assignee: Yazaki Corporation, Tokyo, Japan

[21] Appl. No.: 744,988

[22] Filed: Nov. 7, 1996

[30] Foreign Application Priority Data

Nov. 10, 1995 [JP] Japan ..... 7-292804

[51] Int. Cl.[6] ..... H01R 43/00

[52] U.S. Cl. ..... 29/857; 29/33 M; 29/748; 29/759; 439/752

[58] Field of Search ..... 29/754, 864, 564.4, 29/753, 861, 33 M, 748, 759; 439/310, 488, 748

[56] References Cited

U.S. PATENT DOCUMENTS 4,781,619 11/1988 Ikeda .
5,127,159 7/1992 Kudo et al. .
5,355,583 10/1994 Osumi et al. .
5,414,925 5/1995 Nishida et al. .
5,429,519 7/1995 Murakami et al. .
5,459,924 10/1995 Ohsumi et al. .
5,490,798 2/1996 Murakiami et al. .
5,515,601 5/1996 Maejima .
5,528,821 6/1996 Matsuzawa .
5,586,917 12/1996 Yagi et al. ..... 439/752
5,611,712 3/1997 Morishita et al. .

FOREIGN PATENT DOCUMENTS 7-296939 11/1995 Japan .

*Primary Examiner*—Carl J. Arbes
*Attorney, Agent, or Firm*—Armstrong, Westerman, Hattori, McLeland & Naughton

[57] ABSTRACT

A method of inserting terminal in which a problem that time for search varies with relative position between the wires and the connector is eliminated, and the position of the connector housing can flexibly be determined. The method of inserting terminal according to the present invention comprises the steps of: correcting a relative position of a terminal insertion head against a connector housing while two positions on front end portion on an engagement side of the connector housing being image-processed by a television camera; and inserting a terminal with wire from a rear portion of the connector housing by using the terminal insertion head.

4 Claims, 6 Drawing Sheets

TERMINAL INSERTING METHOD

BACKGROUND OF THE INVENTION

1. Field of the Invention

The present invention relates to a method of securely inserting a terminal into a terminal accommodating chamber of a connector housing through image processing which readily and securely detects the position of a prescribed terminal accommodating chamber of the connector housing.

2. Description of the Related Art

FIG. 5 shows a method of inserting terminal which was proposed by the applicants of the present invention in Japanese Patent Application No. 6-89508.

In this method, a television camera 50 detects a terminal insertion opening 52 of a prescribed terminal accommodating chamber of a connector housing 51, and a terminal 56 is inserted into the chamber by terminal clamping claws 54, 55 of an insertion head 53. At the insertion of the terminal, wire raking claws 57 which rake wires 58 from the connector housing 51 to conserve the required opening 52. The connector housing 51 and the insertion head 53 are not always arranged vertically but may horizontally be arranged.

As illustrated in FIG. 6, a standard image 66 of the opening 52 is stored in advance in the image processor 59 which is connected to the television camera 50. In case that the wire 58 is positioned at the center of the opening 52, the center of the opening 52 can not be detected, so that the position of the opening 52 is determined by the image of the upper left corner 62. In case that the wire 58 is positioned in the upper left corner 62 also, the image of the upper right corner 63 is taken; and if the wire 58 is located in the upper right corner 63, then the image of the lower left corner 64 or the lower right corner 65 is taken one after another to detect the position of the opening 52.

If the wires 58 are located in the four corners of the opening 52, as illustrated in FIG. 7, the images of the upper left corner 67 and the upper right corner 68 on the terminal insertion opening 52 side of the connector housing 51 are taken to index the position of the prescribed opening 52. Based on the data taken by the television camera 50, the terminal cramping claws 54, 55 are moved while calibrating the position thereof through a sequencer 60 and an NC device 61 to insert the terminal 56 into the terminal accommodating chamber.

SUMMARY OF THE INVENTION

With the above-mentioned method of inserting terminal, however, it is required to change the positions where the images are taken one after another in accordance with the position of the wire 58 relative to the opening 52, resulting in a long period of time for the insertion. Further, with this method, it is necessary to arrange the connector housing in such a manner that the wire 58 is not positioned in the upper left corner 67 and the upper right corner 68 as final detecting positions without fail.

The present invention has been accomplished in consideration of the aforementioned problem, and it is therefore an object of the present invention to provide a method of inserting terminal in which a problem that time for search varies with relative position between the wires and the connector is eliminated, and the position of the connector housing can flexibly be determined.

To accomplish the above-mentioned object, the method of inserting terminal according to the present invention comprises the steps of: correcting a relative position of a terminal insertion head against a connector housing while two positions on front end portion on an engagement side of the connector housing being image-processed by a television camera; and inserting a terminal with wire from a rear portion of the connector housing by using the terminal insertion head.

In the above-mentioned method, the front portion of the connector housing may substantially be rectangular, and the two positions on the front end portion may be situated in corners of the front end portion.

In the method described above, the two corners preferably oppose with each other on a diagonal line of the rectangular front end portion of the connector housing. It is possible to select two corners neighbors with each other for image processing.

BRIEF DESCRIPTION OF THE DRAWINGS

The present invention will be more apparent from the ensuring description with reference to the accompanying drawings wherein.

DETAILED DESCRIPTION OF PREFERRED EMBODIMENTS

Now, an embodiment of the present invention will be explained in detail with reference to drawings.

Figure 1:
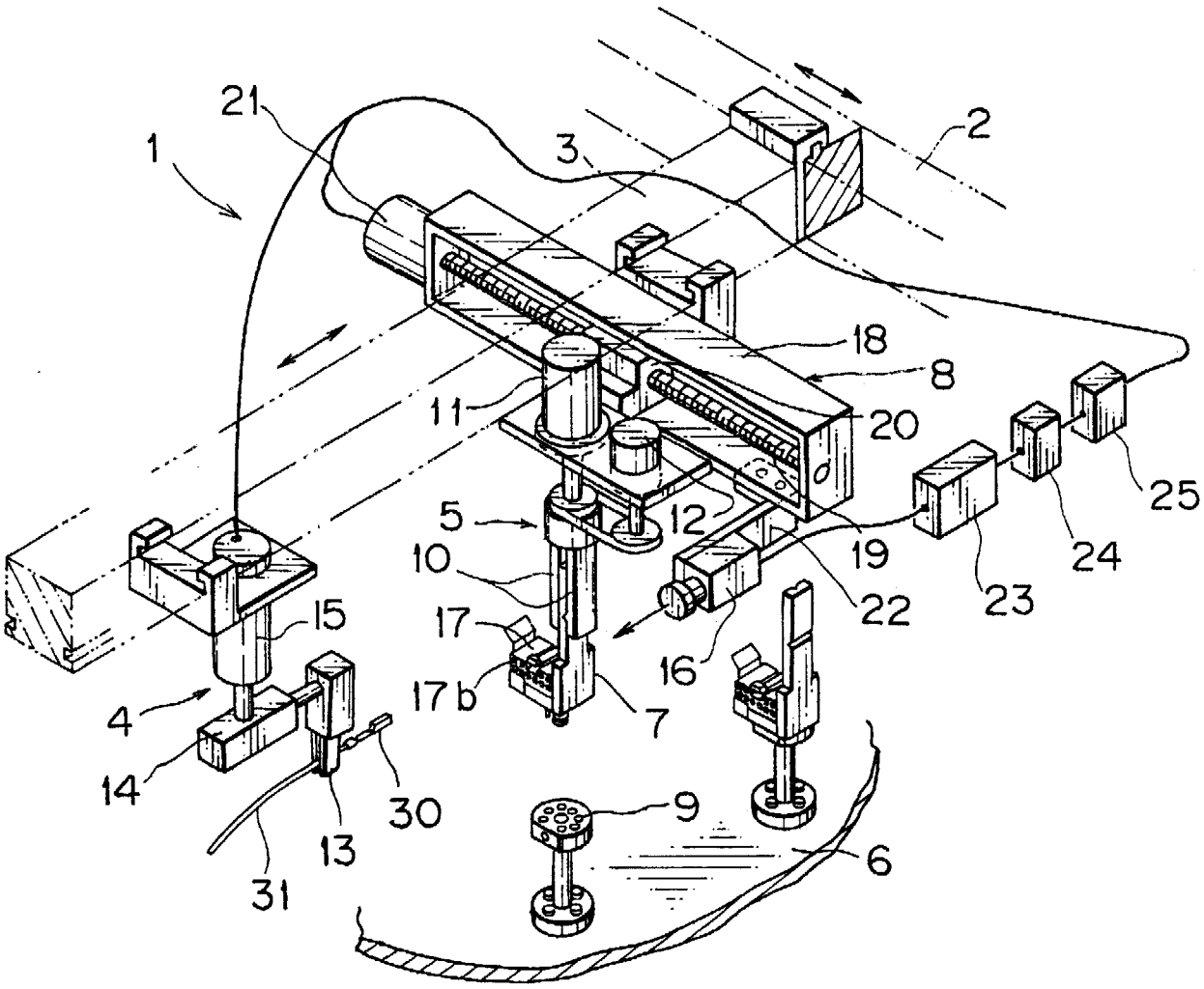
FIG. 1 is a perspective view showing a terminal inserting apparatus to which terminal inserting method according to the present invention is applied.

FIG. 1 shows a terminal inserting apparatus to which the terminal inserting method according to the present invention is applied. The terminal inserting apparatus 1 is provided with a Y-axis beam 3 which is movable along an X-axis beam 2, and a terminal insertion head 4 which is movable along the X-axis beam 2, and a connector holding head 5, and a connector receiver 7 which is supported by a base 9 on a base pallet 6 beneath the Y-axis beam 3.

The connector holding head 5 is mounted to a short X'-axis beam 8, which is movable along the Y-axis beam 3, so as to be movable in the X direction. The connector holding head 5 is positioned behind the X'-axis beam 8 (a direction that terminals are inserted is defined as "forward"), and the terminal insertion head 4 is located behind the connector holding head 5. The connector holding head 5 is provided with a pair of chucks 10 for cramping the connector receiver 7, an elevating cylinder 11 for raising and falling the chucks 10, and a rotary actuator 12 for rotating the chucks 10. The terminal insertion head 4 is provided with cramping claws 13 for cramping a wire with terminal 31, and a horizontal cylinder 14 and a vertical cylinder 15 for horizontally and vertically moving the cramping claws 13 respectively. This construction is already proposed by the present applicants in Japanese Patent Application No. Heisei 7-203344.

The terminal inserting method according to the present invention is characterized in that an engagement side front end portion 17*a* of a connector housing 17 is image-processed through the camera 16. Here, "the engagement side" means the engagement side against a mated connector housing not shown. No wire from the connector housing 17 exists on the front end portion 17*a* side, which permits the camera 16 not to be hindered.

The X'-axis beam 8 comprises a case portion 18, a ball screw shaft 19 inside the case portion, a slide block 20 engaging the ball screw shaft 19, a servo motor 21 rotating the ball screw shaft 19. The camera 16 is secured to the case portion 18 through a bracket 22. Further, the connector holding head 5 is connected to the slide block 20. The camera 16 is connected to the image processor 23, and the image processor 23 is connected to the NC device 25 with a sequencer 24. The NC device 25 is connected to both the servo motor 21 on the X'-axis beam 8 and the vertical cylinder 15 of the terminal insertion head 4 to drive the both 8, 15 of them.

Figure 2A:
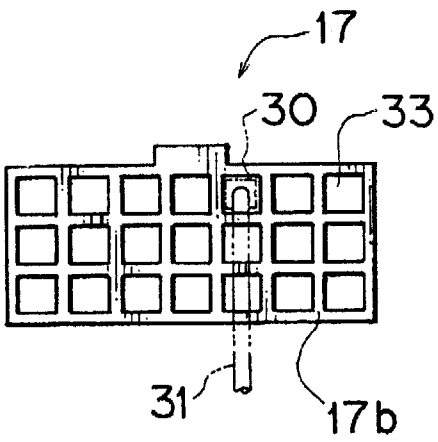
FIGS. 2A, 2B and 2C are a rear view, a lateral cross-sectional view, a front view of a connector housing respectively, to which a terminal is inserted.
Figure 2B:
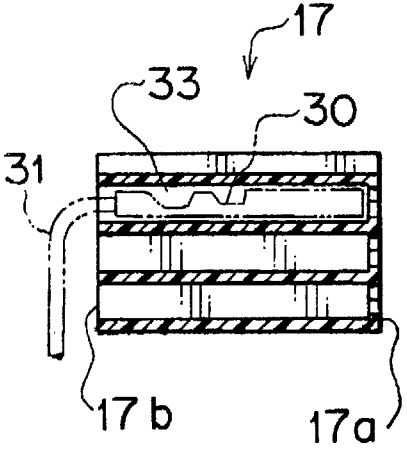
Figure 2C:
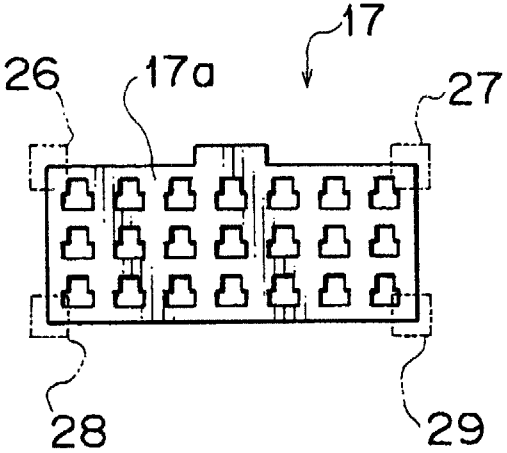

FIGS. 2(*a*) to 2(*c*) show surfaces (rear surface, cross-sectional surface and front surface) of the connector housing 17. In this embodiment, point data (x1, y1) and (x2, y2) indicating two points, for example the corner 26 and the corner 27, of four corners 26 to 29 of the front end portion 17*a* of the connector housing 17 illustrated in FIG. 2(*c*) are registered in advance on the image processor 23 as a standard image.

The reason why the two points which oppose each other on a diagonal line are used is to increase the accuracy of image processing by using farthest two points with each other on the connector housing 17. Not two points opposing with each other on a diagonal line, but neighboring two points such as the upper left corner 26 and the upper right corner 27 may be selected. The terminal 31 from the terminal with wire 30 which is inserted into the connector housing is located behind an insertion opening side rear end 17*b* of the connector housing 17 as described above and is not located in front of the front end portion 17*a*.

The terminal with wire 30 is inserted under the condition that the connector receiver 7 receiving the connector housing 17, as illustrated in FIG. 1, is cramped and elevated from the base 9 by the pair of chucks 10 of the connector holding head 5 and the connector receiver 7 is horizontally moved along the X'-axis beam 8, however, under this condition prior to the insertion of the terminal with wire 30, the two points in the corners 26, 29 of the connector housing 17 shown in FIG. 2(*c*) are taken by the camera 16, and the data (x1',y1') and (x2', y2') and the above-mentioned data (x1, y1) and (x2, y2), which are inputted in advance, are compared with each other. The previous standard image is inputted under the same conditions as described above.

Figure 3A:
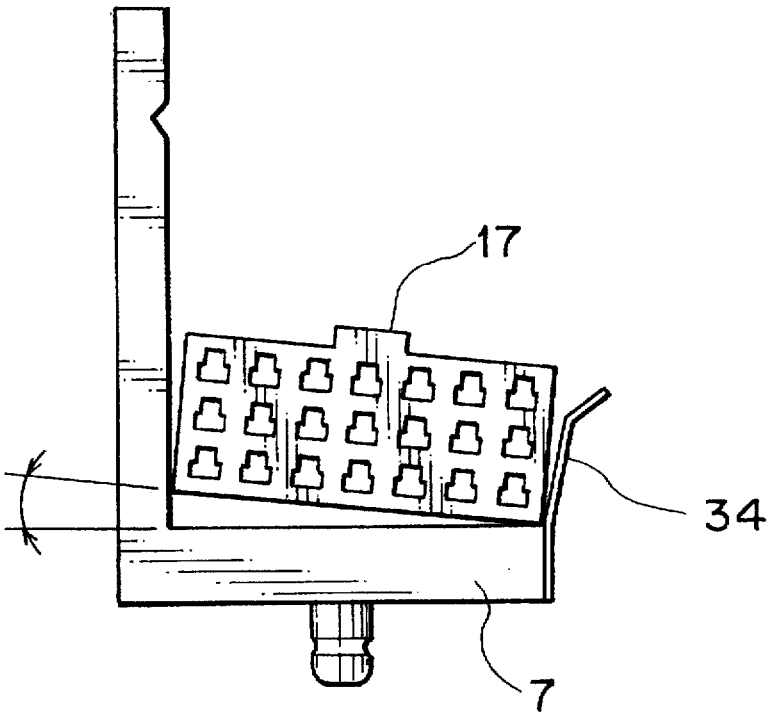
FIG. 3A is a front view of the inclination of the connector housing on a receiver.
Figure 3B:
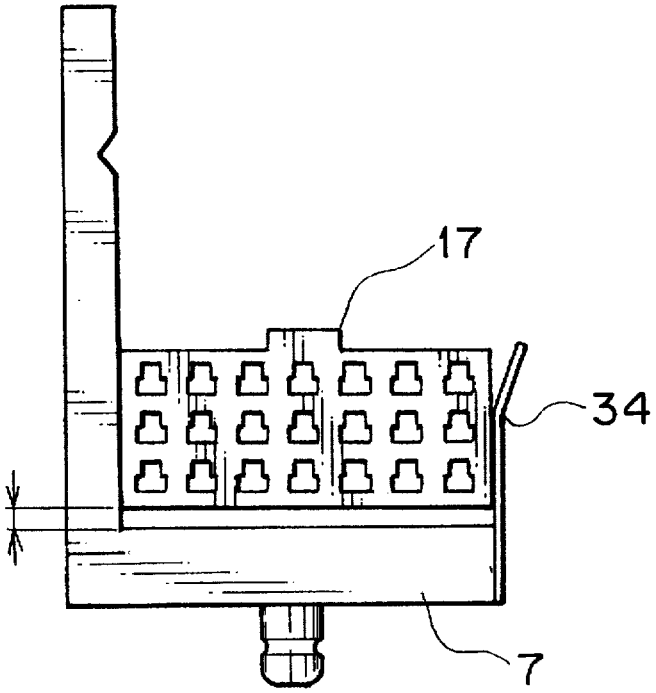
FIG. 3B is a front view showing the rise of the connector housing.

The above-mentioned procedure allows the deviations in inclination and floating of the connector receiver 7 of the connector housing 17 described in FIGS. 3(*a*) and 3(*b*) to be detected. Based on the deviations detected, the inserting position against the terminal accommodating chamber 33 is calibrated by driving a Z-direction cylinder 15 and the X'-axis beam 8 of the terminal insertion head 4.

In FIG. 3, the connector housing 17 is supported on the receiver 7 through a leaf spring 34. The connector housing 17 is supplied to the connector receiver 7 through chucks not shown with the connector receiver 7 being engaged with the base 9 (see FIG. 1). At that moment, there is a fear that slight inclination and rise of the connector housing 17 occur.

Figure 4:
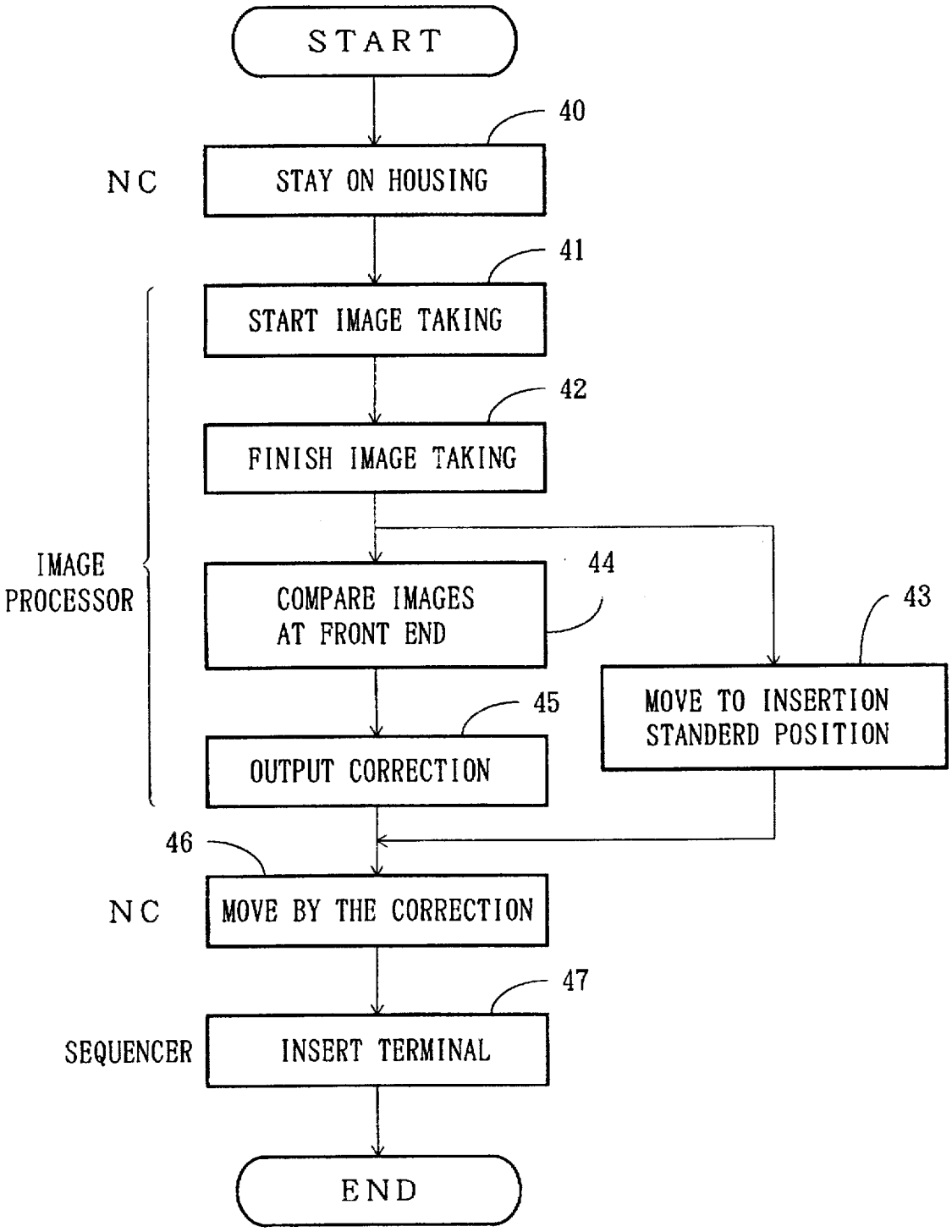
FIG. 4 is a flowchart showing the terminal inserting method.
Figure 5:
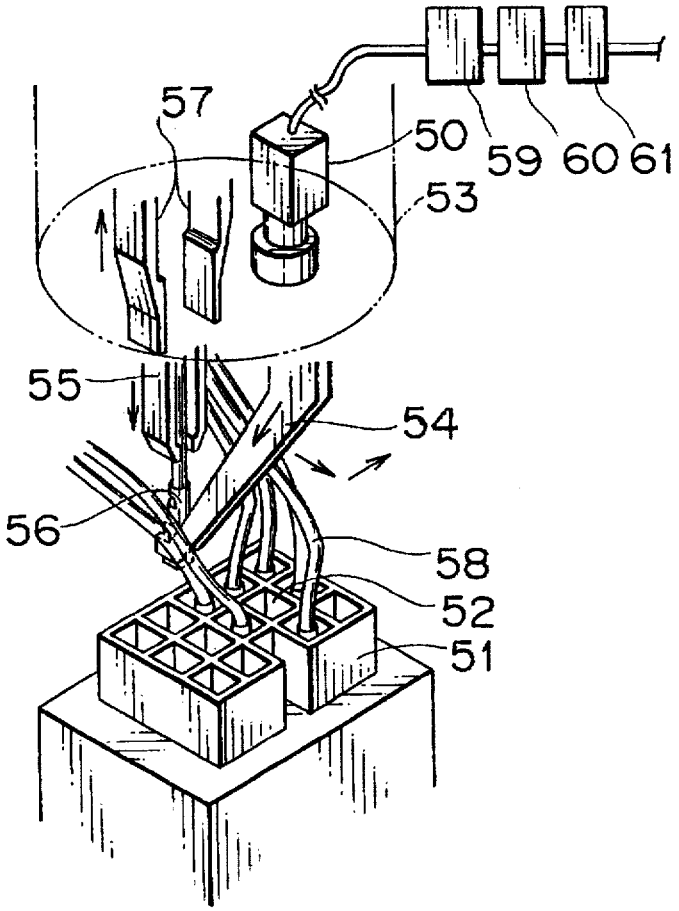
FIG. 5 PRIOR ART
FIG. 5 is a perspective view showing a conventional terminal inserting method.
Figure 6:
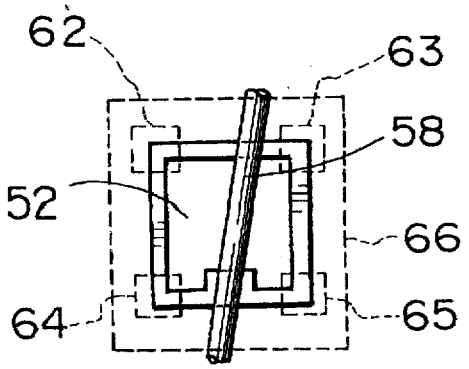
FIG. 6 PRIOR ART
FIG. 6 is a front view showing that a wire is positioned at the rear opening of a terminal accommodating chamber.
Figure 7:
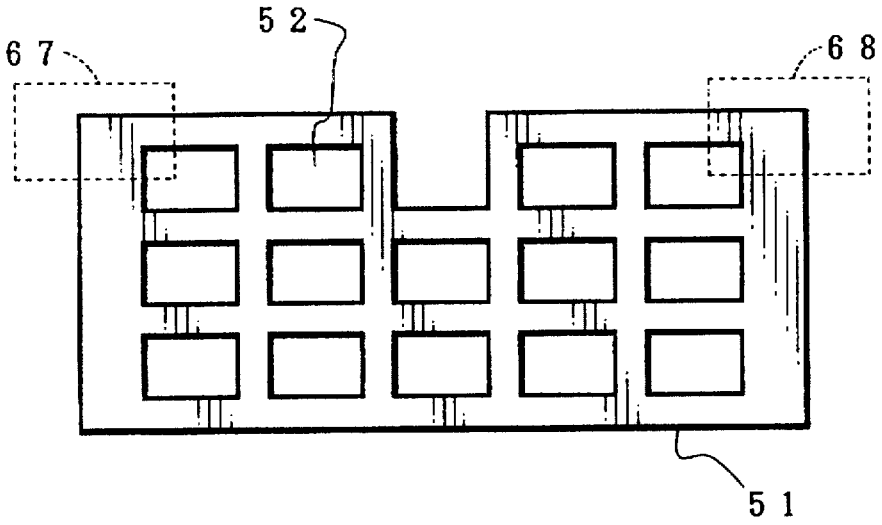
FIG. 7 PRIOR ART
FIG. 7 is a front view showing a conventional method of image-processing corners of the front end portion of a terminal insertion opening of a connector housing.

FIG. 4 shows the flow of the terminal insertion process described above.

That is, at first at step 40, the movement of the X'-axis beam 8 through the NC device 25 positions the front end portion 17*a* of the connector housing 17 at a position opposing the camera 16. Then, at step 41, images are taken in the image processor 23 from the camera 16, and this picture taking-in process is completed at step 42. Then, at step 43, the NC device 25 moves the terminal insertion head 4 to the standard position for insertion.

At the same time, at step 44, the image processor 23 causes the two corners 26 and 29 of the front end portion 17*a* of the connector housing 17 and the standard image are compared. If the image taken by the camera coincides with the standard image, a signal indicating the correction is outputted at step 45 and the NC device 25 moves the terminal insertion head 4 and the connector holding head 5 by the deviation to be corrected from the standard position. Then, at step 47, the terminal insertion head 4 advances to securely insert the terminal with wire 30 into the prescribed terminal accommodating chamber 33 of the connector housing 17.

As described above, with the present invention, the engagement side front end portion of the connector housing without wires is image-processed, so that pattern search is need not be repeated like the conventional method and the front end portion is image-processed at a single step. Therefore, the position of the terminal accommodating chamber can readily be detected, which shortens the time for the insertion process. Further, as described above, it is unnecessary to arrange the connector housing in such a manner that wires are not caught in the corners of the connector housing like the conventional method, which increases the flexibility of the arrangement of the connector housing, and shape resembling a wire harness can be obtained at a terminal insertion process.

What is claimed is:

1. A method of inserting terminal comprising the steps of: correcting a relative position of a terminal insertion head against a connector housing while two positions on front end portion on an engagement side of said connector housing being image-processed by a television camera; and inserting a terminal with wire from a rear portion of the connector housing by using the terminal insertion head.

2. The method of inserting terminal as claimed in claim 1, wherein said front portion of the connector housing is substantially rectangular, and said two positions on the front end portion are situated in corners of said front end portion.

3. The method of inserting terminal as claimed in claim 2, wherein said two corners oppose with each other on a diagonal line of the rectangular front end portion of the connector housing.

4. The method of inserting terminal as claimed in claim 2, wherein said two corners neighbors with each other.

* * * * *